US006907713B2

(12) United States Patent
Thieman

(10) Patent No.: US 6,907,713 B2
(45) Date of Patent: Jun. 21, 2005

(54) METHOD AND APPARATUS FOR PLACING A PRODUCT IN A FLEXIBLE RECLOSEABLE CONTAINER

(75) Inventor: Ronald G. Thieman, Noblesville, IN (US)

(73) Assignee: Pliant Corporation, Schaumburg, IL (US)

( * ) Notice: Subject to any disclaimer, the term of this patent is extended or adjusted under 35 U.S.C. 154(b) by 0 days.

(21) Appl. No.: 10/325,596

(22) Filed: Dec. 19, 2002

(65) Prior Publication Data

US 2003/0220180 A1 Nov. 27, 2003

Related U.S. Application Data

(63) Continuation of application No. 10/209,769, filed on Aug. 1, 2002, which is a continuation of application No. 10/022,451, filed on Dec. 17, 2001, now Pat. No. 6,438,926, which is a continuation of application No. 09/796,262, filed on Feb. 28, 2001, now Pat. No. 6,363,692, which is a continuation of application No. 09/370,053, filed on Aug. 6, 1999, now Pat. No. 6,209,287, which is a continuation of application No. 08/965,722, filed on Nov. 7, 1997, now Pat. No. 5,956,924.

(51) Int. Cl.[7] ..... B65B 61/18; B65B 61/20

(52) U.S. Cl. ..... 53/412; 53/133.4

(58) Field of Search ..... 493/212; 53/412, 53/133.4, 139, 492; 383/5, 61, 63, 64, 65

(56) References Cited

U.S. PATENT DOCUMENTS

| | | | |
|---|---|---|---|
| 3,202,559 | A | 8/1965 | Laguerre |
| 3,426,396 | A | 2/1969 | Laguerre |
| 3,701,191 | A | 10/1972 | Laguerre |
| 4,199,845 | A | 4/1980 | Ausnit |
| 4,241,865 | A | 12/1980 | Ferrell |
| 4,262,395 | A | 4/1981 | Kosky |
| 4,415,386 | A | 11/1983 | Ferrell et al. |
| 4,581,006 | A | 4/1986 | Hugues et al. |
| 4,874,257 | A | 10/1989 | Inagaki |
| 4,890,935 | A | 1/1990 | Ausnit |
| 4,894,975 | A | 1/1990 | Ausnit |
| 4,945,714 | A | 8/1990 | Bodolay et al. |
| 5,007,142 | A | 4/1991 | Herrington |

(Continued)

FOREIGN PATENT DOCUMENTS

| | | |
|---|---|---|
| EP | 0 098 392 A1 | 4/1999 |
| EP | 0 689 993 | 4/1999 |
| GB | 2 085 519 A | 4/1982 |
| WO | WO 98/57863 | 12/1998 |
| WO | WO 99/36325 | 7/1999 |
| WO | WO 99/56947 | 11/1999 |
| WO | WO 99/65353 | 12/1999 |
| WO | WO 00/02722 | 1/2000 |

*Primary Examiner*—John Paradiso
(74) *Attorney, Agent, or Firm*—Brian R. McGinley, Esq.

(57) ABSTRACT

An invention for forming, filling, and sealing a flexible recloseable container. Both vertical and horizontal methods for placing product within the container are disclosed. The invention includes guiding a web of film which has interlocking fastener strips sealed to the web. A slider for locking and unlocking the fastener strips is placed in the correct orientation, spread apart at a pair of inner feet and inserted over the fastener strips. The slider is positioned to close a substantial portion of the strips, and then an end stop, docking station, and corner seal are formed against a sealing plate. The slider is then repositioned, and a tamper evident seal may be placed over the fastener strips.

4 Claims, 6 Drawing Sheets

U.S. PATENT DOCUMENTS 5,007,143 A 4/1991 Herrington
5,010,627 A 4/1991 Herrington et al.
5,020,194 A 6/1991 Herrington et al.
5,024,537 A 6/1991 Tilman
5,063,644 A 11/1991 Herrington et al.
5,067,208 A 11/1991 Herrington, Jr. et al.
5,070,583 A 12/1991 Herrington
5,085,031 A 2/1992 McDonald
5,088,971 A 2/1992 Herrington
5,103,546 A 4/1992 Rossini et al.
5,131,121 A 7/1992 Herrington, Jr. et al.
5,140,796 A 8/1992 Pope
5,152,613 A 10/1992 Herrington, Jr.
5,161,286 A 11/1992 Herrington, Jr. et al.
5,167,608 A 12/1992 Steffens, Jr. et al.
5,179,816 A 1/1993 Wojnicki
5,189,764 A 3/1993 Herrington et al.
5,211,482 A 5/1993 Tilman
5,247,781 A 9/1993 Runge
5,283,932 A 2/1994 Richardson et al.
5,301,394 A 4/1994 Richardson et al.
5,301,395 A 4/1994 Richardson et al.
5,400,568 A 3/1995 Kanemisue et al.
5,405,478 A 4/1995 Richardson et al.
5,417,035 A 5/1995 English
5,425,216 A 6/1995 Ausnit
5,426,830 A 6/1995 Richardson et al.
5,431,760 A 7/1995 Donovan
5,435,864 A 7/1995 Machacek et al.
5,442,838 A 8/1995 Richardson et al.
5,448,807 A 9/1995 Herrington, Jr.
5,448,808 A 9/1995 Gross
5,461,845 A 10/1995 Yeager
5,482,375 A 1/1996 Richardson et al.
5,505,037 A 4/1996 Terminella et al.
5,525,363 A 6/1996 Herber et al.
5,557,907 A 9/1996 Malin et al.
5,561,996 A 10/1996 Chang
5,622,431 A 4/1997 Simonsen
5,638,586 A 6/1997 Malin et al.
5,664,299 A 9/1997 Porchia et al.
5,669,715 A 9/1997 Dobreski et al.
5,722,128 A 3/1998 Toney et al.
5,775,812 A 7/1998 St. Phillips et al.
5,809,621 A 9/1998 McCree et al.
5,816,018 A 10/1998 Bois
5,826,401 A 10/1998 Bois
5,833,791 A 11/1998 Bryniarski et al.
5,836,056 A 11/1998 Porchia et al.
5,857,310 A 1/1999 Bois
5,867,875 A 2/1999 Beck et al.
5,884,452 A 3/1999 Bois
5,896,627 A 4/1999 Cappel et al.
5,938,337 A 8/1999 Provan et al.
5,951,453 A 9/1999 Yeager
5,953,796 A 9/1999 McMahon et al.
5,956,924 A 9/1999 Thieman
6,000,197 A 12/1999 Ausnit
6,003,582 A 12/1999 Blohowiak et al.
6,012,264 A 1/2000 Linkiewicz
6,032,437 A 3/2000 Bois
6,071,011 A 6/2000 Thomas et al.
6,085,491 A 7/2000 Bois
6,088,887 A 7/2000 Bois
6,110,090 A 8/2000 Ausnit
6,110,586 A 8/2000 Johnson
6,115,892 A 9/2000 Malin et al.
6,117,060 A 9/2000 Bodolay
6,131,369 A 10/2000 Ausnit
6,131,370 A 10/2000 Ausnit
6,131,374 A 10/2000 Bois
6,138,439 A 10/2000 McMahan et al.
6,161,271 A 12/2000 Schreiter
6,178,722 B1 1/2001 McMahon
6,199,256 B1 3/2001 Revnew et al.
6,209,287 B1 4/2001 Thieman
6,212,857 B1 4/2001 Van Erden
6,213,640 B1 4/2001 Bois
6,216,423 B1 4/2001 Thieman
6,244,021 B1 6/2001 Ausnit et al.
6,257,763 B1 * 7/2001 Stolmeier et al. ..... 383/5
6,261,000 B1 7/2001 Bois
6,273,607 B1 * 8/2001 Buchman ..... 383/5
6,279,298 B1 8/2001 Thomas et al.
6,286,189 B1 9/2001 Provan et al.
6,286,999 B1 9/2001 Cappel et al.
6,289,561 B1 9/2001 Provan et al.
6,292,986 B1 9/2001 Provan et al.
6,293,896 B1 9/2001 Buchman
6,305,844 B1 10/2001 Bois
6,327,754 B1 12/2001 Belmont et al.
6,334,709 B1 1/2002 Bois
6,339,911 B2 1/2002 Bois
6,343,455 B2 2/2002 Bois
6,376,035 B1 4/2002 Dobreski et al.
2001/0002504 A1 6/2001 Provan et al.
2001/0005973 A1 7/2001 Schneider et al.
2003/0054931 A1 * 3/2003 Buchman et al. ..... 493/394
2003/0185945 A1 * 10/2003 Buchman ..... 426/122

* cited by examiner

METHOD AND APPARATUS FOR PLACING A PRODUCT IN A FLEXIBLE RECLOSEABLE CONTAINER

CROSS REFERENCE TO RELATED APPLICATIONS

This application is a continuation of U.S. patent application Ser. No. 10/209,769, filed Aug. 1, 2002; which is a continuation of U.S. patent application Ser. No. 10/022,451 filed Dec. 17, 2001, which issued as U.S. Pat. No. 6,438,926 on Aug. 27, 2002; which is a continuation of U.S. patent application Ser. No. 09/796,262, filed Feb. 28, 2001, which issued as U.S. Pat. No. 6,363,692 on Apr. 2, 2002; which is a continuation of U.S. patent application Ser. No. 09/370,053, filed Aug. 6, 1999 which issued as U.S. Pat. No. 6,209,287 on Apr. 3, 2001, which is a continuation of U.S. patent application Ser. No. 08/965,722, filed Nov. 7, 1997 which issued as U.S. Pat. No. 5,956,924 on Sep. 28, 1999, all of which are incorporated herein by reference.

BACKGROUND OF THE INVENTION

The present invention relates to a method and apparatus for placing a product in a flexible, recloseable container. However, certain applications may be outside of this field.

Flexible, recloseable containers such as zipper-type plastic bags are a significant advancement in the field of prepackaged items both for industrial and retail uses. The packaging industry recognizes the importance of using interlocking fastener profile strips to provide the ability to reclose the container after first use. It is also important that it be easy for the user to reliably close the interlocking strips. For instance, some containers utilize multi-colored interlocking strips to make it easier for the consumer to determine if a container is closed. Another way in which to provide for reliable interlocking is by the use of a slider that opens the interlocks when moved in one direction, and closes the interlocks when moved in the other direction. Sliders have not been applied to flexible, recloseable containers being filled with a product on a form, fill, and seal machine. What is needed is a method for incorporating a slider on a flexible, recloseable container that is formed, automatically filled with a product, and sealed. The present invention provides this in a novel and unobvious way.

SUMMARY OF THE INVENTION

One aspect of the present invention provides a method for placing the product in a flexible recloseable container. The method includes feeding a web of flexible film with interlockable fastener strips. A slider is oriented to a predetermined orientation, and placed over the fastener strips. The slider is moved relative to the fastener strips such that the fastener strips are generally closed. A transverse seal is generally formed across the film and a product is placed within the web.

Another aspect of the present invention provides an apparatus for placing a product in a flexible recloseable container. The apparatus includes means for feeding a web of flexible film with interlockable fastener strips, the strips including shoulders. There is also a slider for locking and unlocking the fastener strips, the slider having feet. The apparatus also includes a slider application machine for placing the slider on the fastener strips. The slider application machine includes a rotatable selector wheel and a spreading ridge. The wheel includes a pocket for accepting the slider and moving the slider while it is in contact with the spreading ridge, such that the feet are spread apart sufficiently to pass freely over the shoulders of the fastener strips. There is also a sealing mechanism for forming at least a partial transverse seal generally across the film. The apparatus also includes means for placing a product within the web of flexible film.

It is an object of the present invention to provide an improved method for placing a product in a flexible recloseable container.

This and other objects of the present invention will be found in the claims, description, and drawings of the embodiments of the present invention to follow.

DESCRIPTION OF THE PREFERRED EMBODIMENT

Figure 1:
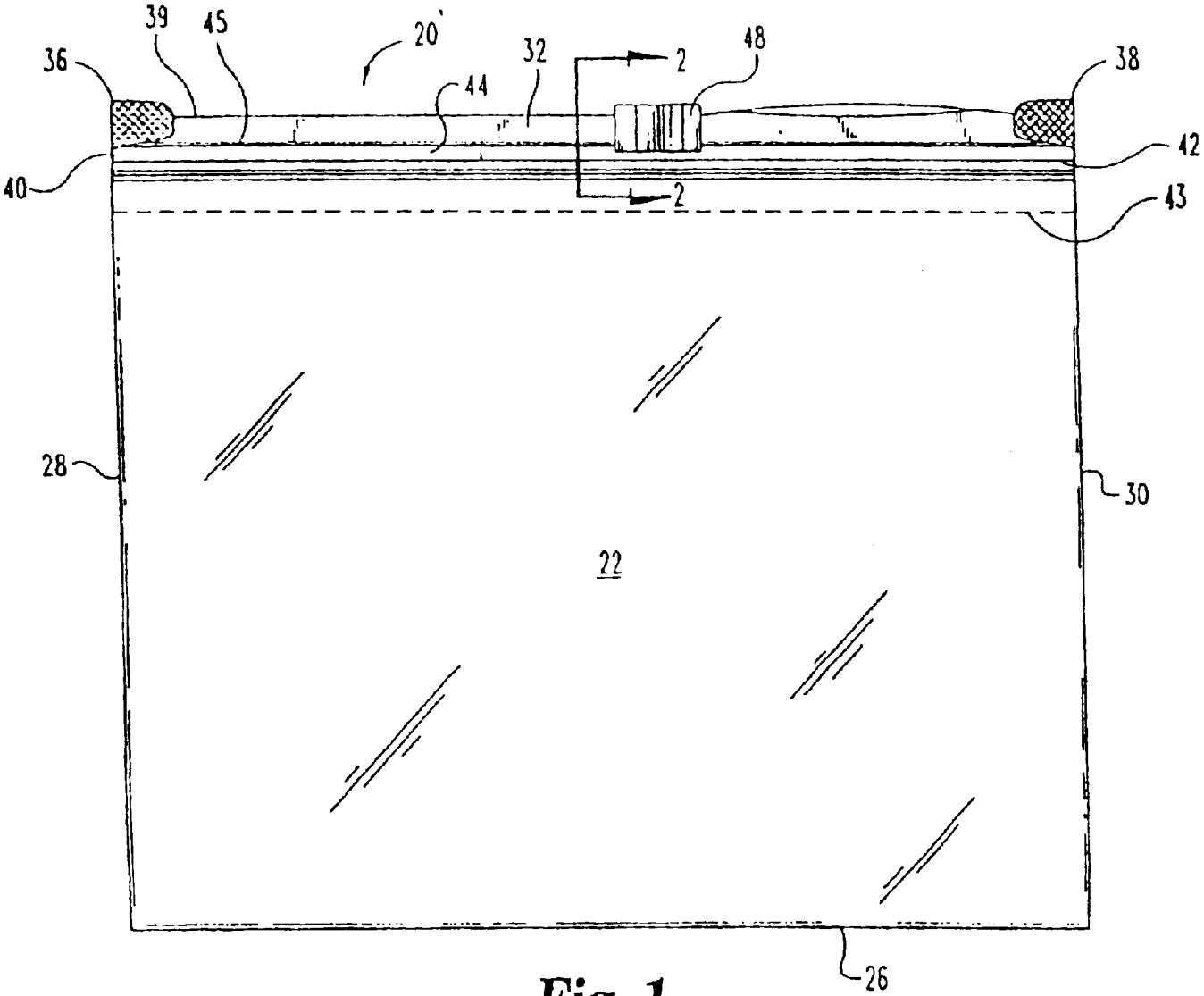
FIG. 1 shows a flexible recloseable container for containing a product, the container being suitable for being formed, filled, and sealed in several embodiments of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows a flexible recloseable container 20 for containing a product, container 20 useful for being formed, filled, and sealed in several embodiments of the present invention container 20 comprises first and second sidewalls 22 and 24, respectively, which may be made from any suitable thermoplastic film such as, for example, low density polyethylene, linear low density polyethylene, or similar materials. Sidewalls 22 and 24 include first left transverse side seal 28 and second right transverse side seal 30. Container 20 also includes a bottom edge 26 generally opposite a pair of interlocking fastener strips 32 and 34. Bottom edge 26 may include a fold between sidewalls 22 and 24, such as for a container formed using some embodiments of a vertical form, fill and seal apparatus, or alternatively edge 26 may include a seal between sidewalls 22 and 24, such as for a container 20 formed using other embodiments of a horizontal form, fill, and seal apparatus.

Figure 2:
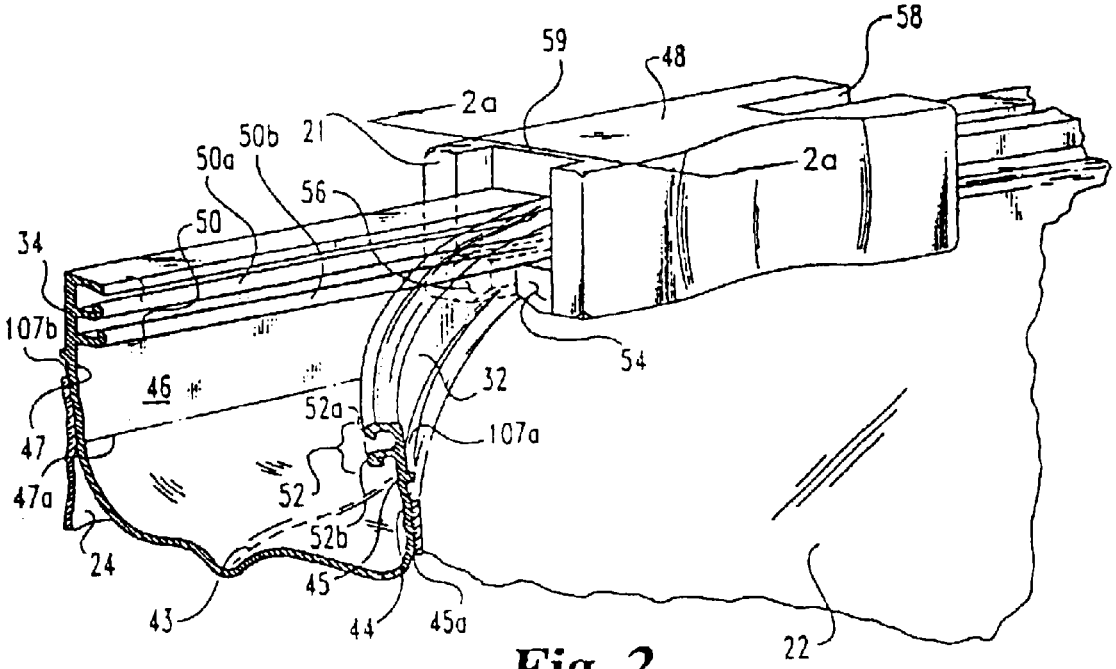
FIG. 2 is an enlarged perspective fragmentary cross sectional view of the container of FIG. 1 as taken along line 2—2 of FIG. 1, with one sidewall partially peeled away from the other sidewall.

FIG. 2 is an enlarged cross section of the container of FIG. 1 as taken along line 2—2 of FIG. 1 with sidewall 22 partially peeled away from sidewall 24. As shown in both FIGS. 1 and 2, interlocking strips 32 and 34 of fastener profiles run along the top edge of container 20. Strips 32 and 34 are sealed together at endstops 36 and 38. A docking station 39 is located near endstop 36. Strips 32 and 34 are sealed to each other and also to sidewalls 22 and 24 at corner seals 40 and 42. Corner seals 40 and 42 are located along their respective edges of container 20. Seals 40 and 42 are generally located below shoulders 45 and 47 of fastener strips 32 and 34, respectively, and above lower edges 45*a* and 47*a* of inner flanges 44 and 46 of fastener strips 32 and 34, respectively. In one embodiment of the present invention, container 20 includes a tamper-evident seal 43 between sidewalls 22 and 24. Seal 43 may be an extension of flanges 46 and 44 that extends internally across the opening of container 20. Seal 43 may be integrally molded with flanges 44 and 46, or may be attached separately. The broken or unbroken state of seal 43 provides evidence to the user of whether or not container 20 has been previously opened. A tamper evident seal is especially useful with a form, fill, and seal machine that inserts an edible product into container 20.

Slider 48 is slidable upon fastener strips 32 and 34. Movement of slider 48 along the fastener profiles results in either an interlocking of profiles 50 and 52, or an unlocking of profiles 50 and 52. In some embodiments of the present invention profiles 50 and 52 are comprised of uppermost and bottommost closure elements. In one embodiment there is an uppermost closure element 50*a* that interlocks with uppermost closure element 52*a*, and a bottommost closure element 50*b* that interlocks with bottommost closure element 52*b*. In a more preferable embodiment of the present invention separator 60 has a length sufficient to separate elements 50*a* and 52*a*, and its length is otherwise kept to a minimum. In this manner, separator 50 is kept from interferring with spreading ridge 314 of slider application machine 114, as will be shown later. It is preferable that slider 48 be cast or molded as a single piece, such that subsequent spreading of slider 48 by slider application machine 114 does not unduly stress a joint between separate slider components.

Figure 2A:
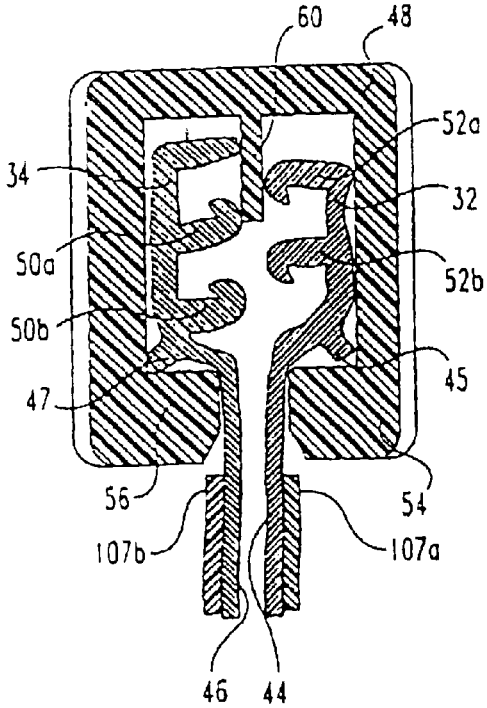
FIG. 2*a* is a partial cross-sectional view of the container of FIG. 2 as taken along line 2*a*—2*a* of FIG. 2.

FIG. 2*a* is a partial cross-sectional view of the container of FIG. 2 as taken along line 2*a*—2*a* of FIG. 2. Slider 48 is shown enclosing non-interlocked portions of fastener strips 34 and 32. A separator 60 separates closure elements 50*a* and 523. Feet 54 and 56 of slider 48 retain slider 48 on the interlocking strips by shoulders 45 and 47, respectively.

Figure 3:
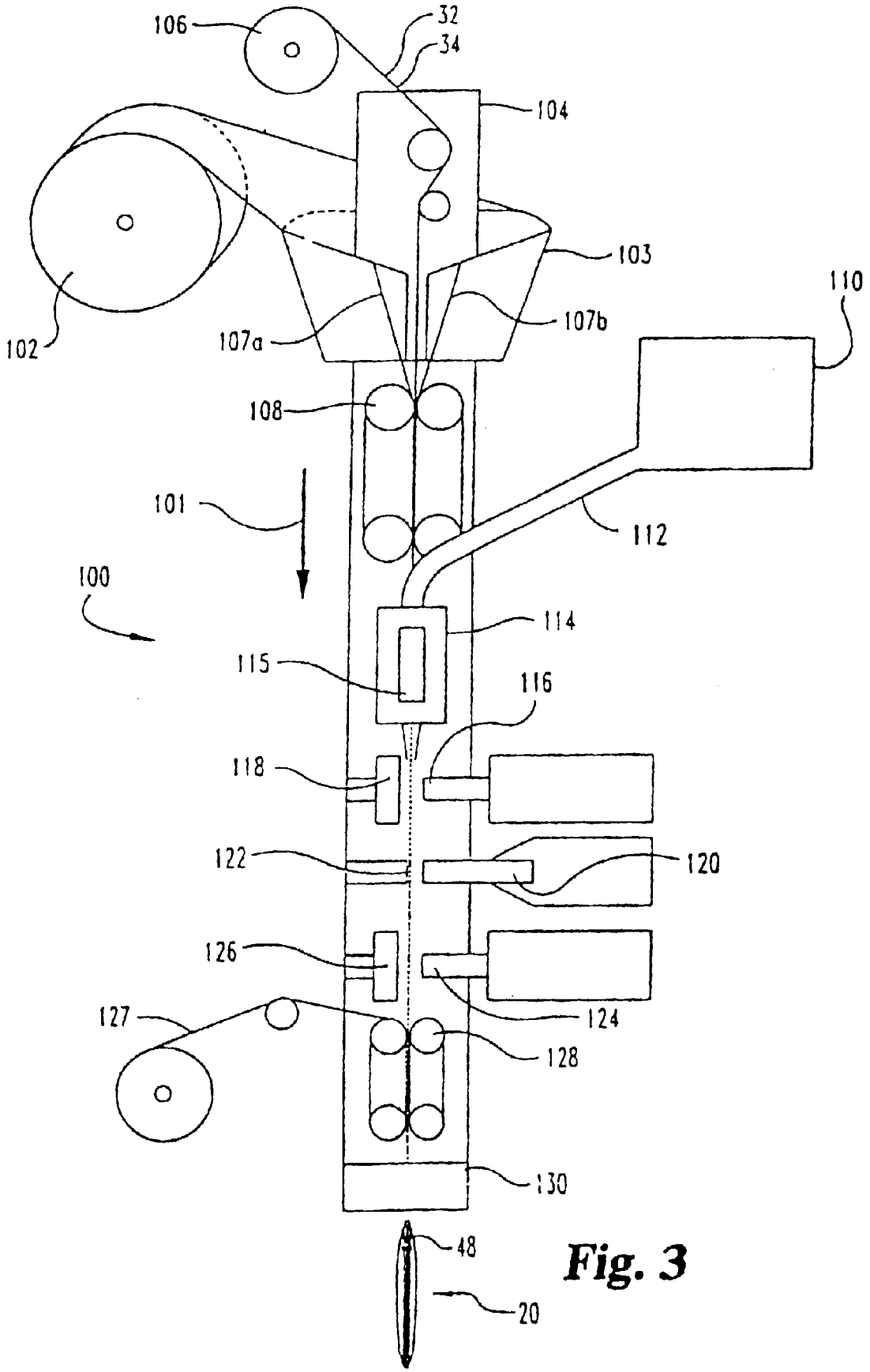
FIG. 3 is a schematic representation of apparatus 100, one embodiment of the present invention, for forming, filling, and sealing a container in a substantially vertical manner.

FIG. 3 is a schematic representation of apparatus 100, one embodiment of the present invention. Apparatus 100 is useful for forming, filling, and sealing a flexible recloseable container such as, for example, container 20 in a generally vertical orientation. Apparatus 100 includes rollers, belts, or similar devices for feeding film web 102 to a film guide 103 that accepts the sheet of web 102 and forms it into a generally tubular shape over the outside of filling tube 104, with web 102 proceeding in a direction as indicated by arrow 101. The supply 102 of film web is in a sheet form, as depicted.

Interlocking strips 32 and 34 of fastener profile are provided from a supply 106. Alternatively, some embodiments of the present invention include interlocking strips 32 and 34 which have previously been made integral with web 102. Strips 32 and 34 are substantially interlocked as provided, and pass over one or more guiding and tensioning rollers, and then between free edges 107*a* and 107*b* of web 102. Sealing mechanism 108 forms a continuous seal along edge 107*a* of web 102 and fastener strip 32, including a portion of inner flange 44. Sealing mechanism 108 is preferably of a type that utilizes either heated metal bars or electrical impulse sealing bars. It is preferable that edge 107*a* seal against and overlap flange 44 and not shoulder 45. Likewise, free edge 107*b* is sealed along inner flange 46 of fastener strip 34, and preferably does not overlap shoulder 47, although there may be overlapping of the free edge and the shoulder in some embodiments of the present invention. In a more preferable embodiment of the present invention, strips 32 and 34 are oriented relative to edges 107*a* and 107*b*, respectively, such that free edges 107*a* and 107*b* are not between feet 54 and 56, respectively, so as to facilitate placement of slider 48 on strips 32 and 34 by slider application machine 114.

A vibrating hopper 110 provides sliders 48 to channel 112 in an orientation appropriate for insertion of slider 48 onto fastener strips 32 and 34. Slider 48 is preferably oriented on fastener strips 32 and 34 such that the more narrow, interlocking end 58 of slider 48 faces in direction of the movement 101 of film web 102. The wider, unlocking end 59 of slider 48 is thus oriented opposite to direction of motion 101. Channel 112 provides sliders 34 to slider application machine 114. The present invention also contemplates those embodiments in which unlocking end 59 is oriented to face in the direction of movement 101.

Slider application machine 114 includes a motor-driven rotating selector wheel 115 which rotates within a semicircular pocket of mounting block 302. Selector 115 rotates in a direction indicated by arrow 304 about axis of rotation 306. Sidewalls 22 and 24 of web 102, with fastener strips 32 and 34 attached, move in direction 101. A stationary probe 309 spreads apart fastener strips 32 and 34 as the strips move toward slider application machine 114. Probe 309 is shown extending from channel 112 and preferably passing between both sets of closure elements 50*a* and 52*a*, and 50*b* and 52*b*. However, it is also acceptable in some embodiments of the present invention that probe 309 extend only between top closure elements 50*a* and 52*a*. In this manner the bottom closure elements remain interlocked, and slider 48 need not be spread apart as much to pass over the bottom closure elements 50*b* and 52*b*. This partial opening by probe 309 would be useful in those embodiments of the present invention that utilize sliders 48 that cannot be spread apart far enough to extend over the bottom closure elements.

Figure 4:
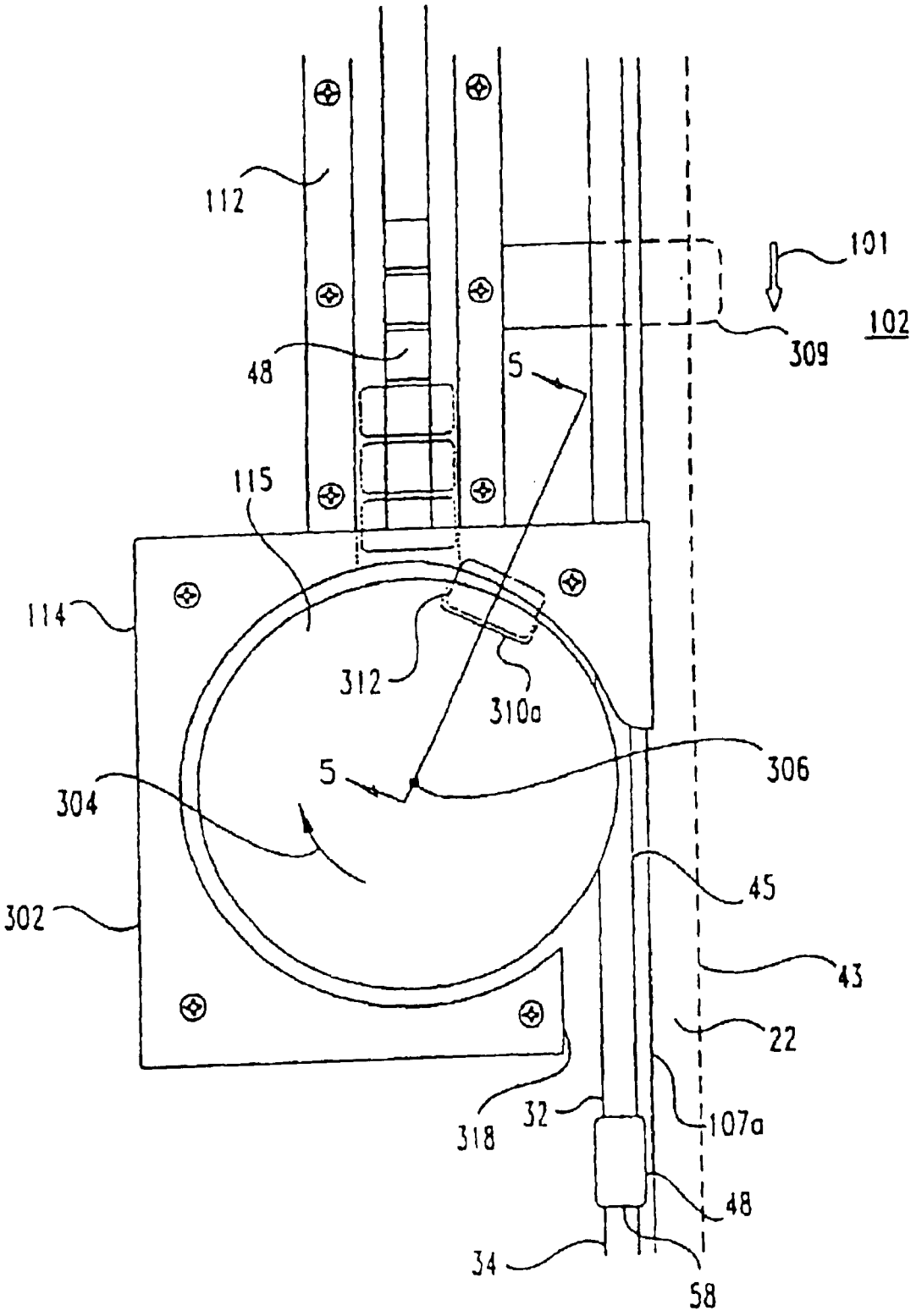
FIG. 4 shows a side elevational view of a slider application machine useful with the present intention.
Figure 5:
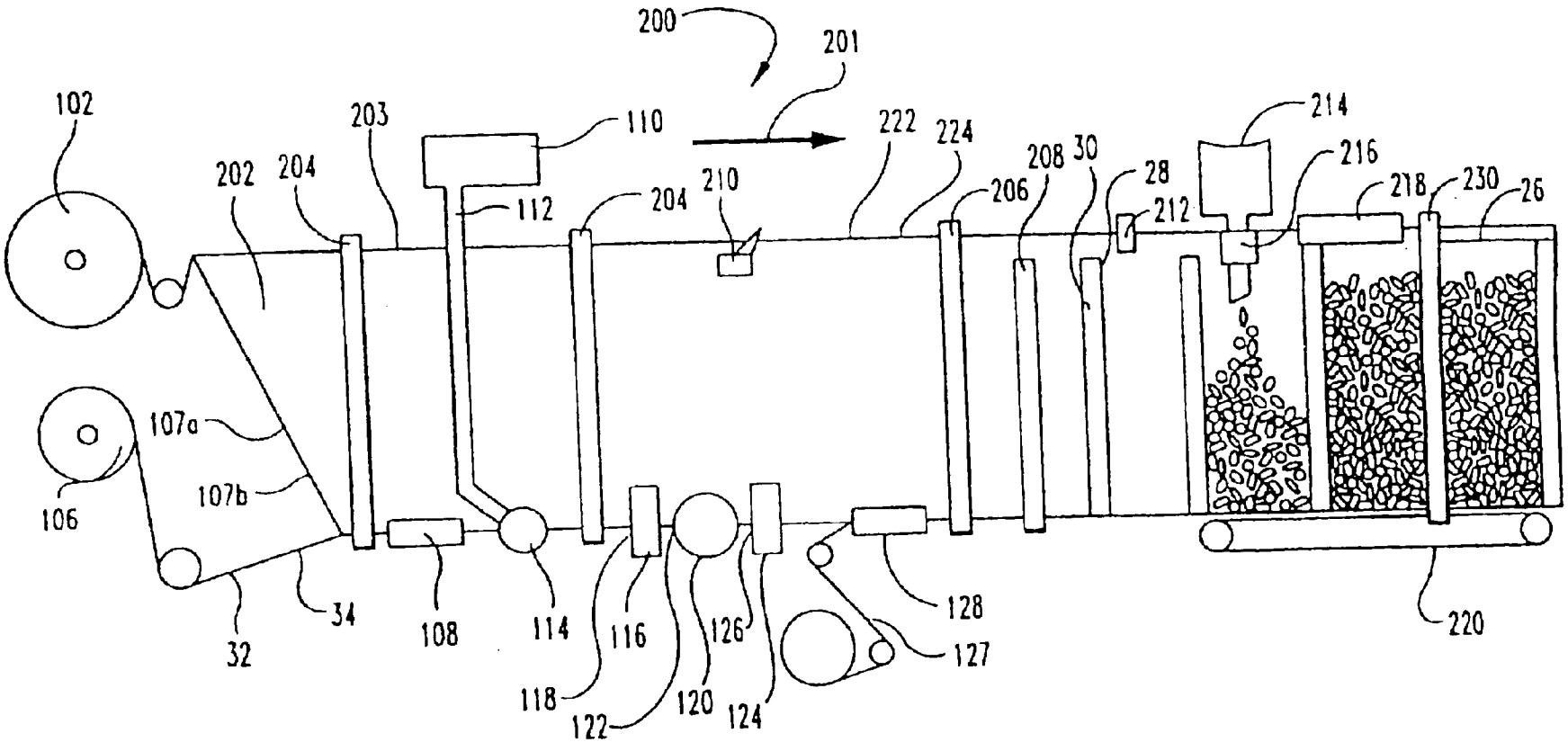
FIG. 5 is a schematic representation of a side view of apparatus 200, another embodiment of the present invention, for forming, filling, and sealing a container in a substantially horizontal manner.

FIG. 4 shows a side elevational view of a slider application machine useful with the present invention. Selector 115 includes within it four pockets 310. A first pocket 310 is shown after having accepted a slider 48 out of channel 112. As seen in FIG. 5, as selector 115 rotates, pocket trailing edge 312 pushes slider 48 past a spreading ridge within block 302. The ridge contacts feet 54 and 56 of slider 48. The spreading ridge has a cross-sectional width that increases in the direction of rotation of selector 115. The height of the spreading ridge must be compatible with the length of separator 60 of slider 48 such that the two do not interfere during the spreading operation. As slider 48 is pushed along the spreading ridge, feet 54 and 56 are spread apart a sufficient distance to pass over closure elements 50 and 52 and shoulders 45 and 47. The present invention also contemplates those embodiments in which feet 54 and 56 also pass over edges 107*a* and 107*b*, respectively.

Web 102 traverses along filling tube 104, with strips 32 and 34 passing through a guiding slot within mounting block 302. The guide ensures proper orientation of the fastener strips 32 and 34 prior to placement of slider 48 on the strips. It is preferable that web 102 momentarily stop as selector 115 is rotated about 90 degrees. The positional movements or selector 115 and web 102 are synchronized such that a single slider 48 is placed on each container 20. In one embodiment of the present invention this synchronization is achieved by controlling both the rotational actuation of selector 115 and the flow of web 102. This control may be achieved by an analog controller that senses the stoppage of web 102, such as, by way of example only, a positional sensor on a gear train driving rotating sealing mechanism 108, or by an optical sensor that stops web 102 when a particular visual feature of web 102 passes in front of the sensor. As another example, synchronization may be achieved by a digital electronic controller that actuates selector 115 after determining from an encoder that a portion of web 102 equivalent to the width of container 20 as gone past machine 114 since the last slider 48 was placed over strips 32 and 34.

A pocket 310 with a slider 48 located therein is rotated to position slider 48 on web 102. Slider 48 moves over the spreading ridge and is spread open. Selector 115 then places slider 48 over fastener strips 32 and 34 at a first location before feet 54 and 56 have had sufficient time to return to their normal unspread configuration. Slider 48 returns to its unspread configuration under the influence of elastic forces within slider 48. Selector 115 stops rotation at a position with the pocket leading edge pulled away from contact with interlocking end 58 of slider 48. Web 102 is free to continue moving along filling tube 104 without interference from pocket 310. Edge 318 of mounting block 302 is cut back a sufficient amount to permit slider 48 to freely pass thereby. By momentarily stopping web 102 as selector 115 is rotated, and also by moving the pocket leading edge away from contact with slider 48, it becomes unnecessary to coordinate the rotational speed of selector 115 with the linear speed of web 102. Web 102 is preferably static when slider 48 is applied. The present invention also contemplates those embodiments in which either or both selector 115 and web 102 move in a generally continuous fashion.

After placing a slider 48 over fastener strips 32 and 34 at the first location, slider 48 is then held in a static position by positioning arm 116 and slider receiver 118 as film web 102 continues to be pulled down filling tube 104. Arm 116 may be a pocket or hand located at the end of a pneumatic cylinder, the pocket or hand having a shape complementary to a portion of slider 48. Actuation of the cylinder places the pocket or hand near slider 48 and constrains slider 48 to a position. Receiver 118 may be a pocketed plate or a flat plate that helps constrain motion of slider 48 when arm 116 is actuated.

Arm 115 and receiver 118 thus position slider 48 such that it does not interfere with the formation of corner seals 40 and 42. Because of the orientation of interlocking end 58 to face in the direction of the flow of web 102, holding slider 48 stationary as web 102 continues to move ensures that interlocking strips 32 and 34 are interlocked downstream of each slider 48. For those embodiments of the present invention in which unlocking end 59 faces in the direction of the flow of web 102, the present invention contemplates moving slider 48 relative to web 102 such that strips 32 and 34 are interlocked downstream of each slider 48.

A portion of this interlocked length of strips 32 and 34 is presented between sealing horn 120 and sealing plate 122. A pneumatic cylinder places horn 120 at a second location along fastener strips 32 and 34 and free ends 107*a* and 107*b*, and against sealing plate 122. By means of heat, ultrasonic energy, or similar process horn 120 fuses the portions of fastener strips and sidewall between horn 120 and sealing plate 122 and simultaneously forms a corner seal 40 and endstop 36 of a first container 20, and a corner seal 42 and endstop 38 of an adjacent, second container 20. It is preferable that horn 120 and sealing plate 122 not alter shoulders 45 and 47, such that there remains shoulders 45 and 47 generally across the width of container 20 to restrain slider 48.

As the assembly of web 102, fastener strips 32 and 34, and slider 48 move down along filling tube 104, there is a second repositioning of slider 48. Slider 48 is positioned adjacent the second location fused by horn 120 and sealing plate 122 by positioning arm 124 which holds slider 48 stationary against slider receiver 126, in a manner similar to the positioning by arm 116 and receiver 118. It is preferable, but not necessary, that slider 48 be moved in a manner which interlocks strips 32 and 34 and positioned adjacent endstop 36 before endstop 36 is fully hardened. The softened area of strips 32 and 34 adjacent endstop 36 is thereby permanently deformed by slider 48. This movement of slider 48 into the previously fused area has been observed to reduce leakage from container 20. This permanently deformed area is docking station 39.

In some embodiments of the present invention, a tamper evident seal 127 is provided over guiding and tensioning rollers and into a second sealing mechanism 128. Mechanism 128 fuses a tamper evidence exterior seal 127 near free ends 107*a* and 107*b* of web 102, and over the exterior of slider 48 and fastener strips 32 and 34. In other embodiments of the present invention, a tamper evident interior seal 43 is located inside and between fastener strips 32 and 34, as indicated by dotted line 43 of FIG. 1. In other embodiments of the present invention it is not necessary to have a tamper evident seal.

As web 102 flows off of filling tube 104, a cutting and sealing mechanism 130 places a seal transversely across sidewalls 22 and 24. Having thus formed the first transverse seal of container 20, a product may be placed into the vertically extending filling tube 104 to thus fall within container 20. When container 20 is full and flows off of tube 104, sealing and cutting mechanism 130 forms the other transverse seal of container 20, and severs container 20 from web 102. The sealing and cutting mechanism 130 simultaneously forms the lower seal of the next container 20.

FIG. 5 is a schematic representation of a side view of another embodiment of the present invention, apparatus 200 for forming, filling, and sealing a container such as container 20 in a substantially horizontal manner. The use of similar element numbers denotes elements substantially related to those already described.

A web 102 of film is fed over rollers and along a folding guide 202 in a horizontal direction as indicated by arrow 201. Guide 202 folds web 102 in half, with fold 203 preferably located above free edges 107*a* and 107*b*. It is also acceptable that fold 203 be located laterally to edges 107*a* and 107*b*, such that web 102 is generally placed in a horizontal plane. A supply of interlocking fastener strips 32 and 34 are guided into alignment with free edges 107*a* and 107*b*, and sealed thereto by sealer 108. Feeding mechanisms 204 generally guide and feed web 102. Rollers, belts, and similar devices are suitable as feeding mechanisms 204.

Sliders 48 are placed along fastener strips 32 and 34 by machine 114 in a manner previously described. Sliders 48 are positioned by arm 116 and receiver 118, a fused spot is created by horn 120 and sealing plate 122, and slide 48 is repositioned by arm 124 and receiver 126, all in a manner as previously described. A tamper evident seal 127, if desired, may be applied to container 20 by sealer 128 in a manner as previously described.

Prior to the formation of transverse seals, it is necessary to open the bottom edge 203 of container 20 for subsequent introduction of the product. A slitter 210 cuts through the fold. Slitter 210 is preferably a static mechanism that cuts bottom edge 203 as web 102 is pulled past slitter 210. Bottom edge 203 is cut into bottom free edges 222 and 224. Shortened rollers 212 continue to guide and feed web 102.

A pre-sealing mechanism 206 applies sufficient heat and pressure to web 102 to substantially flatten web 102 thereat, but not so much heat or pressure as to fuse the web sidewalls. This pre-sealing mechanism 206 substantially removes wrinkles that may exist in web 102. A sealing mechanism 208 creates partial transverse seals for container 20 at the flattened web position. Sealing mechanism 208 is preferably of a type that utilizes either heated metal bars or electrical impulse sealing bars. Sealing mechanism 208 creates partial transverse seals 28' and 30' that extend substantially but not completely across sidewalls 22 and 24. Mechanism 208 fuses a partial transverse seal from free edges 107*a* and 107*b* across sidewalls 22 and 24 to a point about one-half inch away from bottom free edges 222 and 224. By not forming transverse seals completely across sidewalls 22 and 24, there remains a portion along bottom free edges 222 and 224 which is useful for guiding and feeding web 102 and also for subsequent opening and filling of container 20.

After forming partial transverse seals, a product is placed within container 20. Container 20 is useful for containing products that are generally flowing in nature, such as small pieces of candy, granular products, and liquids. For example, with products of the type which have a flowing nature it is preferable that container 20 be oriented in a substantially vertical manner as it continues to move horizontally. FIG. 5 schematically depicts a apparatus 200 in which a flowing product such as candy is being gravity fed from a hopper 214 into a container 20. Container opening mechanism 216 spreads apart bottom free edges 222 and 224 as the motion of web 102 is momentarily halted. Mechanism 216 may use mechanical fingers to hold and spread apart edges 222 and 224. Alternatively, mechanism 216 may incorporate suction devices that grasp and spread apart edges 222 and 224.

After introduction of the product into container 20, free edges 222 and 224 are fused together by bottom sealing mechanism 218. Mechanism 218 places a wide sealing area on container 20, such that a seal is formed that overlaps with partial transverse side seals 28' and 30'. In this way, the approximate one-half inch not sealed by sealing mechanism 208 is instead sealed by mechanism 218. Following the placement of a bottom seal, a cutting mechanism 230 severs adjacent containers 20 through the full transverse side seal 28 and 30. It may also be necessary to trim some of the sealed bottom edge of container 20.

Figure 6:
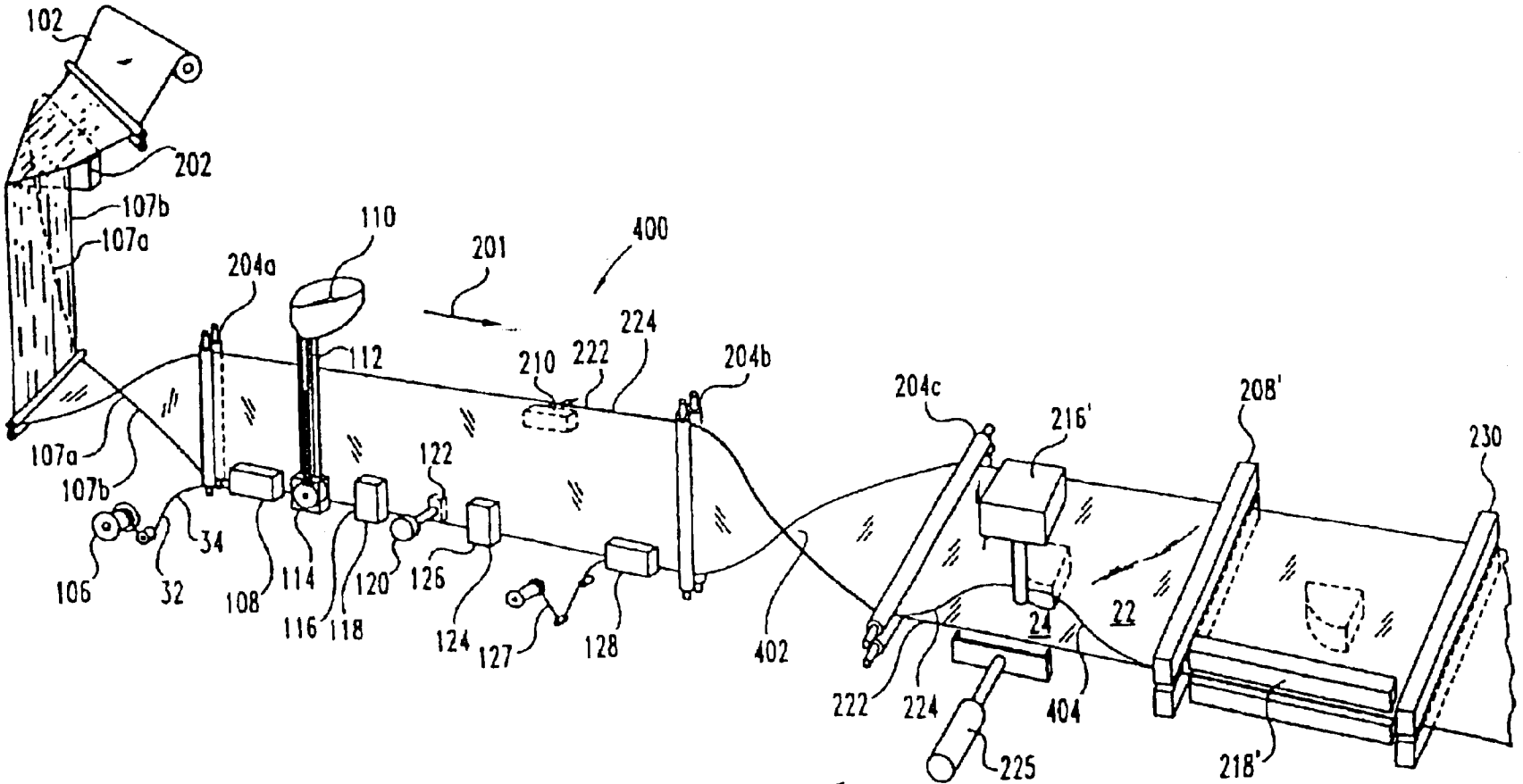
FIG. 6 is a perspective schematic of apparatus 400, another embodiment of the present invention, for forming, filling, and sealing a container in a substantially horizontal manner.

Container 20 is also useful for larger products with a well defined shape, such as cheese and large candy bars. Web 102 may require reorientation based upon the type of product to be inserted within container 20. For placement within container 20 of those products that are large and have a definite shape it is preferable that web 102 be in a substantially horizontal plane, such that free edges 222 and 224 are at about the same elevation as fastening strips 32 and 34. FIG. 6 is a perspective schematic of apparatus 400, one embodiment of the present invention, for forming, filling, and sealing a container in a substantially horizontal manner. Apparatus 400 begins in a manner similar to that of apparatus 200. Web 102 is fed by rollers 204 along a substantially horizontal path, preferably in a vertical orientation. Alternatively, web 102 may be pulled in a horizontally planar orientation. Fastener strips 32 and 34 are attached and sealed to web 102, a slider 48 is placed on the strips, and a tamper evident seal, if desired, is attached.

In those embodiments in which web 102 is pulled by rollers 204 in a vertical orientation, there is a subsequent reorientation of web 102 to a horizontal plane. As web 102 passes through second roller set 204*b* there is a twist 402 of 90 degrees before web 102 passes through third set of rollers 204*c*. It is preferable to support the underside of the non-horizontal web 102. This support may be in the form of a belt or roller conveyor, for example.

A spreading mechanism 216' holds free edge 224 and lifts it vertically, creating opening 404 within web 102. In some embodiments it may be helpful to permit that portion of web 102 downstream of mechanism 216' to return toward mechanism 216', such that the lifting of free edge 224 does not unduly stress sidewall 22. A product is placed within sidewalls 22 and 24 of web 102 by placement mechanism 225 and free edge 224 is brought back into contact with edge 222. Transverse side seals 28 and 30 across web 102 are formed by sealing machine 208'. Sealing machine 203' places a full transverse seal across web 102. Sealing machine 208' must also separate sufficiently such that the product within container 20 may pass therebetween. Free edges 224 and 222 are then fused together by heat, ultrasonic energy, or other method by bottom sealer 218'. Bottom sealer 218' applies a slightly narrower seal than bottom sealer 218, because of the full transverse seal applied by sealing mechanism 208'. A cutting mechanism 230 then severs container 20 from web 102 through the transverse seals.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of using a package, the package comprising a surrounding wall defining a package interior, a zipper closure having a slider device mounted thereon, the zipper closure comprising a first interlocking closure profile having a first sealing flange and a second interlocking closure profile having a second sealing flange, a first tamper evident-structure encasing the slider device, and a second tamper evident-structure encasing the sealing flanges, the surrounding wall being attached to the second tamper evident-structure; the method comprising:

(a) penetrating the first tamper evident-structure to expose the slider device;

(b) moving the slider device along the zipper closure to unmate the first and second interlocking closure profiles; and (c) penetrating the second tamper evident-structure to gain access to the package interior.

2. The method of claim 1 wherein said moving is after said penetrating the first tamper evident-structure.

3. A flexible, reclosable package comprising:

(a) a surrounding wall defining a package interior;

(b) a zipper closure comprising a first interlocking closure profile and a second interlocking closure profile, each of the closure profiles having a distal end and a sealing flange disposed opposite the distal end, the zipper closure providing access to the package interior;

(c) a slider device operably mounted on the first and second closure profiles; the slider device constructed and arranged to interlock the first closure profile with the second closure profile when the slider device is moved in a first direction, and to disengage the first closure profile from the second closure profile when the slider device is moved in a second opposite direction, the slider device mounted on the distal ends of the closure profiles;

(d) a first tamper evident-structure encasing the slider device; and (e) a second tamper evident-structure encasing the sealing flanges of the closure profiles, the second tamper evident-structure positioned between the package interior and the closure profiles, the surrounding wall being sealed to the second tamper evident-structure.

4. The package of claim 3 wherein said first tamper evident-structure encases the distal ends of said closure profiles.

* * * * *